US005217403A

United States Patent [19]

Nobbs

[11] Patent Number: 5,217,403

[45] Date of Patent: Jun. 8, 1993

[54] MATERNITY SUPPORT UNDERGARMENT

[75] Inventor: Vestal L. Nobbs, 3334 Hacienda Blvd., Hacienda Heights, Calif. 91745

[73] Assignees: Mulford J. Nobbs; Vestal L. Nobbs, both of Los Angeles, Calif.

[21] Appl. No.: 759,382

[22] Filed: Sep. 13, 1991

[51] Int. Cl.[5] ..... A41C 1/08

[52] U.S. Cl. ..... 450/155; 2/237; 2/406

[58] Field of Search ..... 2/76, 221, 237, 400, 2/401, 406; 450/155, 136, 132, 123, 124, 122

[56] References Cited

U.S. PATENT DOCUMENTS

| | | | |
|---|---|---|---|
| Re. 22,665 | 8/1945 | Mahoney | 2/76 |
| Re. 23,818 | 4/1954 | Vraciu | 2/76 X |
| D. 218,586 | 9/1970 | Williams et al. | 450/155 X |
| 1,633,610 | 6/1927 | Schneider | 2/401 X |
| 1,923,112 | 8/1933 | Nickerson | 450/155 X |
| 2,099,238 | 11/1937 | Simpson | 2/237 |
| 2,259,236 | 10/1941 | Wellins et al. | 2/76 |
| 2,462,195 | 2/1949 | Jacobson | 2/406 |
| 2,513,039 | 6/1950 | Miller | 2/406 |
| 2,646,572 | 7/1953 | Eudy | 2/401 |
| 3,142,300 | 7/1964 | Erteszek | 450/124 X |
| 3,221,750 | 12/1965 | Blair | 450/124 X |
| 3,245,410 | 4/1966 | Martin | 450/132 X |
| 3,406,692 | 10/1968 | Pernas | 450/132 X |
| 3,487,418 | 12/1969 | Jacobs | 2/221 |
| 3,621,849 | 11/1971 | Williams | 450/155 |
| 4,893,358 | 1/1990 | Bice, Jr. | 2/76 X |
| 4,956,878 | 9/1990 | Boynton | 2/67 |
| 4,981,480 | 1/1991 | Gaudet et al. | 2/221 X |

FOREIGN PATENT DOCUMENTS

| | | | |
|---|---|---|---|
| 519576 | 12/1955 | Canada | 2/406 |
| 2443811 | 8/1980 | France | 2/237 |

*Primary Examiner*—Clifford D. Crowder
*Assistant Examiner*—Jeanette E. Chapman
*Attorney, Agent, or Firm*—Beehler & Pavitt

[57] ABSTRACT

A maternity support undergarment integrating a support panel with a pantie for supporting the abdominal area of a pregnant women. The support panel is adjustable for allowing proper support to be imparted to a women's abdominal area throughout the duration of her pregnancy.

5 Claims, 3 Drawing Sheets

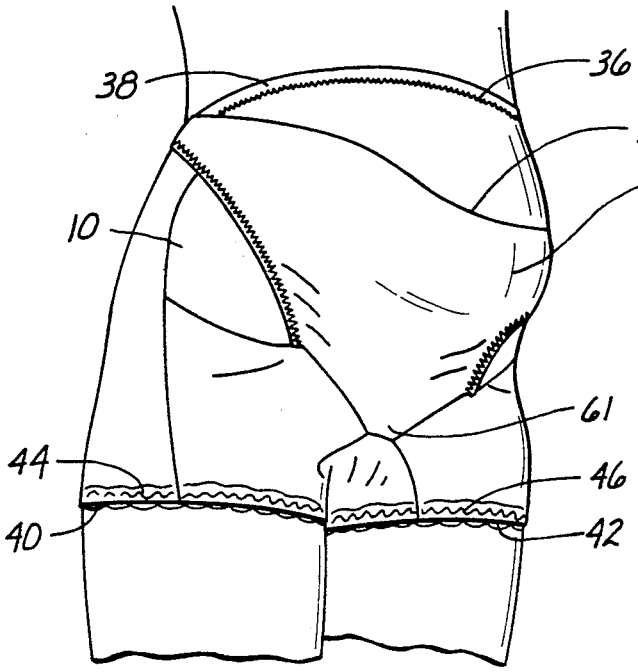
Fig. 1
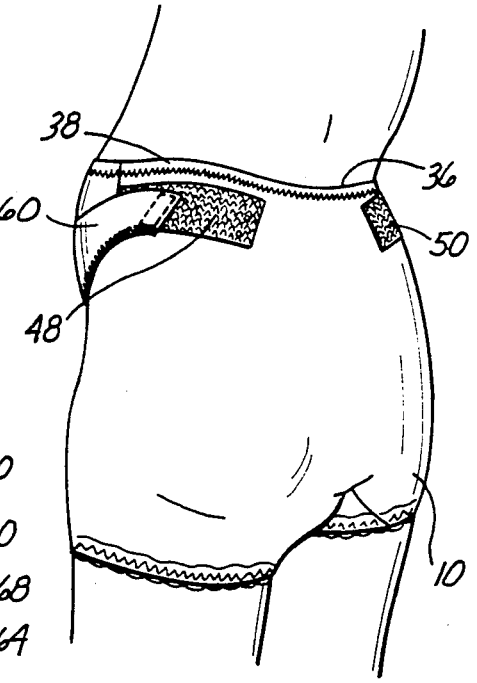
Fig. 2
Fig. 3
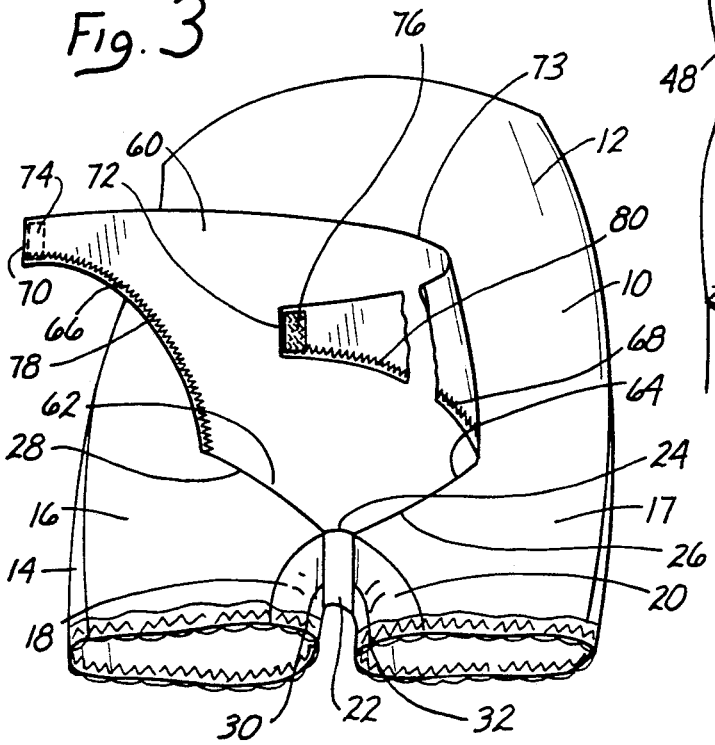

14
18
20
22
30
32
34
48
50
70
72
78
80
92
94
96
98
100
120
5
5

MATERNITY SUPPORT UNDERGARMENT

FIELD OF THE INVENTION

This invention relates generally to undergarments to be worn by pregnant women and more specifically to undergarments which provide adjustable support to the abdominal area of a pregnant woman during the entire pregnancy.

BACKGROUND OF THE INVENTION

During pregnancy, the additional weight and size of the fetus creates considerable strain and discomfort on the abdominal muscles of the pregnant woman. Simple tasks like sitting or rising from a chair become difficult because of the added weight in the abdominal area. The natural tendency of the body is to increase the use of back muscles to compensate for the inability of the abdominal muscles to carry the additional weight. This creates considerable strain and discomfort on both the back and abdominal muscles. This discomfort is obviously most prevalent during the latter months of pregnancy when the fetus has grown to its largest and heaviest size.

A structure that lifts and supports the expanded abdominal region would take the stress off of the back muscles and would allow for a more comfortable pregnancy. Prior expedients have been incorporated into maternity undergarments, such as girdles, which are ineffective in relieving the stress on the back muscles and which do not take into account the ever increasing size and weight of the fetus during pregnancy.

A maternity undergarment which provides the necessary lift and support must consider and adapt to the expanding size and shape of the abdominal area.

Thus, there is a need for a support structure which supports a pregnant women's abdominal area and which is adjustable to provide support for the full range of sizes and shapes which occur during pregnancy.

In order for such a garment to be worn for long periods of time, it must be lightweight and comfortable.

Also, such a garment should be designed to allow for an attractive appearance for the woman wearing it.

BRIEF SUMMARY OF THE INVENTION

This invention is a support undergarment for a pregnant woman which integrates a support panel with a pantie. One edge of the support panel is preferably attached to the crotch area of the pantie. The means by which the support panel is attached to the pantie is preferably by sewing the edge of the support panel into a seam which is conveniently located in the crotch area of the pantie. This garment is made of soft knitted fabric and is very comfortable in all positions. There is no stiff elastic which causes discomfort from the edges of the pantie, as in other undergarments of this type. The support panel is made of a stretchable fabric the same as, or similar to, the fabric normally used in the pantie. The support panel has a top edge opposite the crotch edge. The top edge is relatively longer than the crotch edge and is adapted to stretch across the lower abdominal area such that a first end of the top edge is located on the back of a woman wearing the pantie and the opposite end is also located on the back of the woman wearing the pantie. These two top ends of the upper edge of the support panel each contain temporary fastening means which allow these two ends to be temporarily fastened to the rear of the pantie.

The support panel is preferably made of a material which is biaxially stretchable, with greater relative elasticity in the axial direction extending from the top edge to the crotch edge of the panel. The support panel is preferably made of the same fabric as the pantie, but is positioned to provide the proper stretch. The pantie provides stretch in its width to comfortably receive the expansion of the hips and waist of the pregnant woman. The panel, however, has less relative elasticity in the direction extending from side-to-side to provide a firm support of the abdominal area.

Depending upon the design of the pantie, the sewing of the support panel in the crotch seam should provide sufficient strength to the point of attachment and allow for sufficient support of the abdominal area by the support panel. However, if additional strength and support is desired, or required, additional portions of the support panel adjacent the crotch edge can be integrated, preferably sewn, with a portion of the leg edges of the pantie.

The means by which the top ends of the support panel are temporarily fastened to the rear of the pantie preferably include fasteners. The top ends of the support panel are preferably provided with fasteners and the rear of the pantie is preferably provided with strips of material which include mating means which mate with the fasteners. The mating strips are placed in strategic locations on the rear portion of the pantie which allow the support panel to be placed in a comfortable position to lift and support the abdominal area of the woman. The rear of the pantie can be provided with one very large strip of mating material or two or more smaller strips of mating material. The more area on the rear of the pantie which is covered with mating material, the more positions are available for the support panel to support the abdomen. Ideally, there are sufficient amounts of mating strips to allow the top ends of the support panel to be placed in any of the plurality of locations which provide the required support and lift to the woman's abdominal area throughout her pregnancy.

To provide additional support and strength, elastic bands are preferably sewn along the exposed edges of the pantie and support panel.

While the specification concludes with claims particularly pointing out and distinctly claiming the subject matter which is regarded as the invention, it is believed that the invention, the objects and features of the invention, and further objects, features and advantages thereof will be better understood from the following description taken in connection with accompanying drawings in which:

BRIEF DESCRIPTION OF THE DRAWINGS

FIG. 1 is a front perspective view of a preferred embodiment of this invention being worn and fastened by a woman.

FIG. 2 is a rear perspective view of the embodiment shown in FIG. 1.

FIG. 3 is a front perspective view of the preferred embodiment not being worn and unfastened.

DETAILED DESCRIPTION OF THE PREFERRED EMBODIMENT

Figures 4, 5, 7:
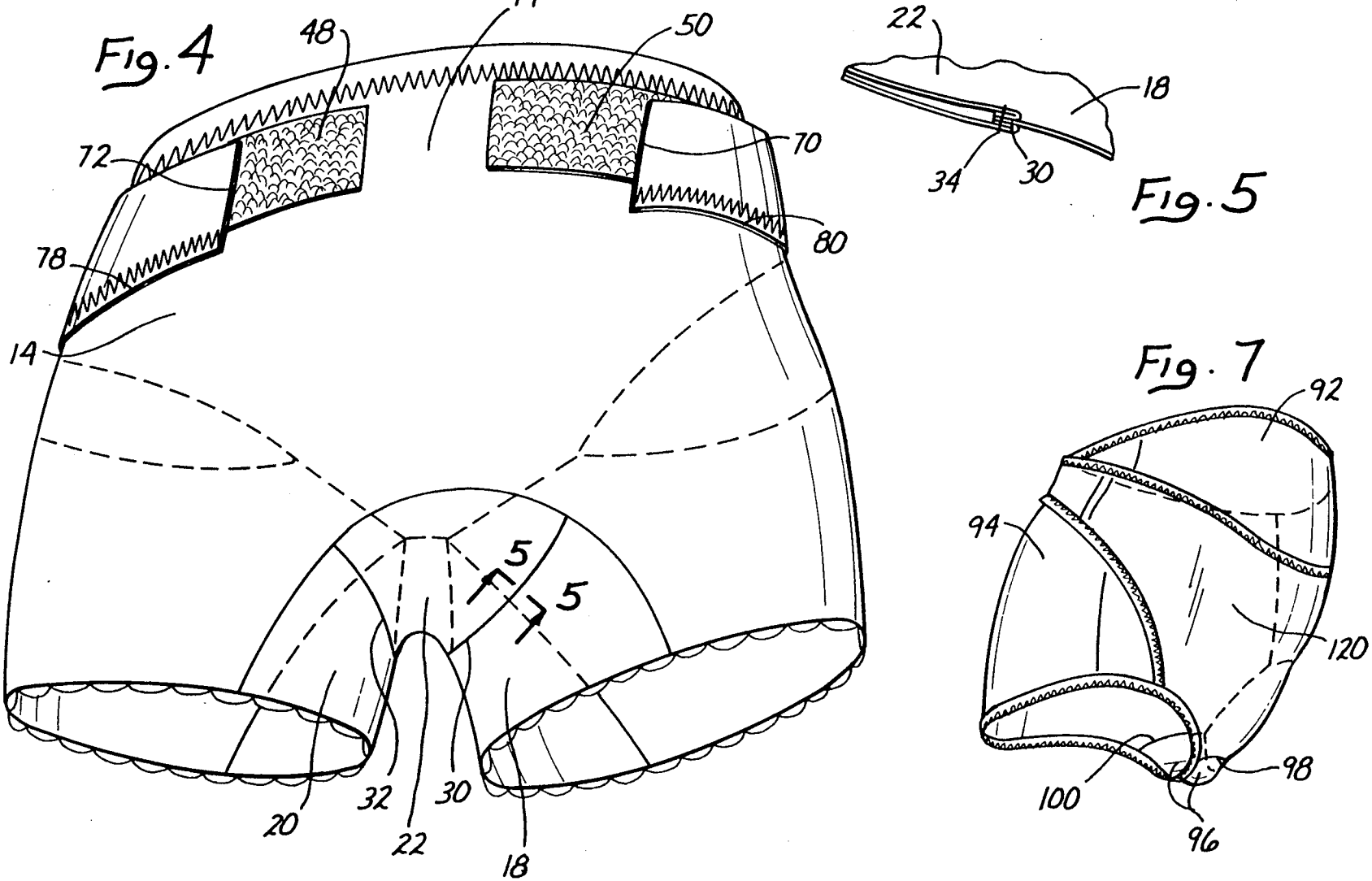
FIG. 4 is a rear perspective view of the preferred embodiment unworn and fastened.
FIG. 5 is a cross sectional view along line 5—5 of FIG. 4.
FIG. 7 is a front perspective view of the second embodiment unworn and fastened.
Figure 6:
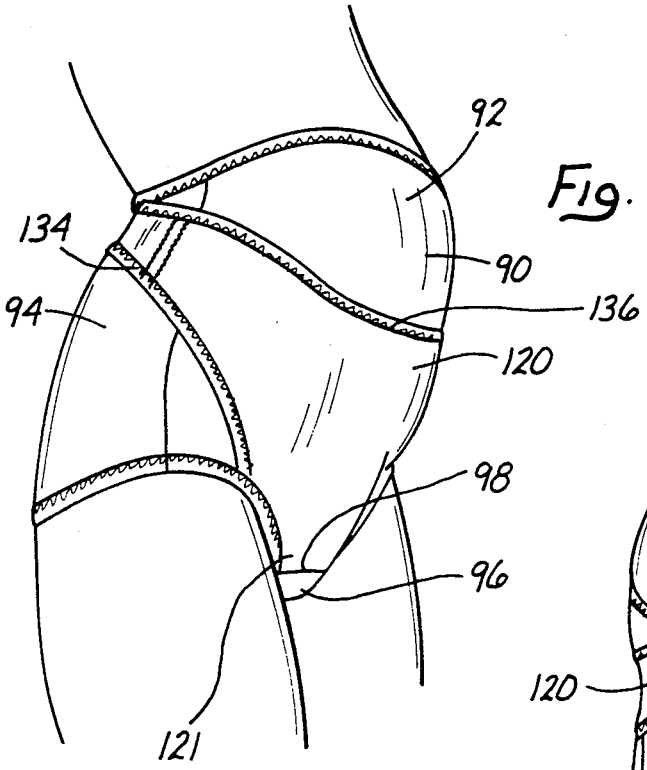
FIG. 6 is a front perspective view of a second preferred embodiment of this invention being worn and fastened by a woman.
Figure 8:
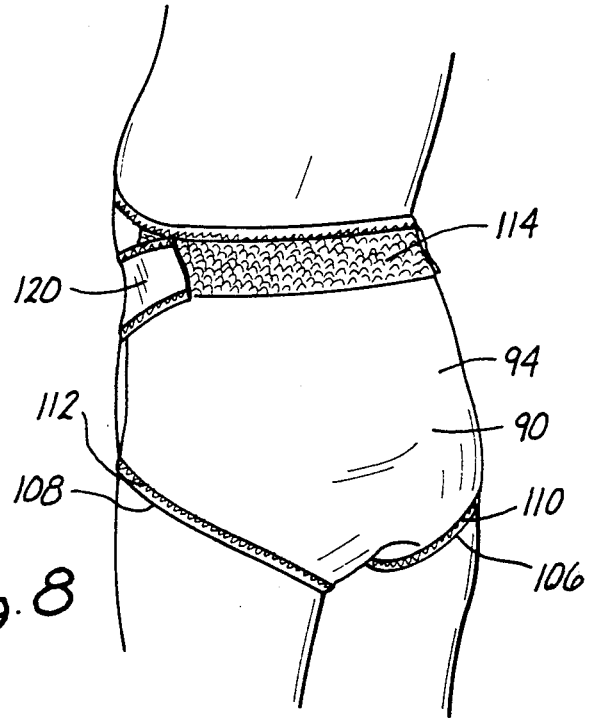
FIG. 8 is a rear perspective view of the second embodiment worn and fastened.
Figure 9:
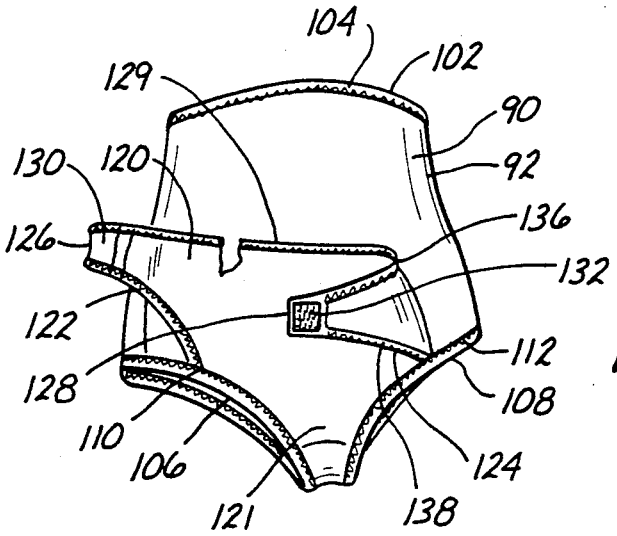
FIG. 9 is a front perspective view of the second embodiment unworn and fastened.

A preferred embodiment of this invention is shown in FIGS. 1 through 4. Pantie 10 includes a top front section 12, a rear section 14, two lower front sections 16 and 17, two side crotch sections 18 and 20, and a midcrotch section 22. Each of these sections are sewn together as shown in the figures. The resulting seams are defined as top front crotch seam 24, lower front crotch seams 26 and 28, and side crotch seams 30 and 32. Sections 12–22 are sewn together in such a way so as to provide a neat, smooth and comfortable seam for the woman wearing the pantie 10. Many types of stitching might provide such a seam. A preferred fold-over stitch 34 is shown in detail in FIG. 5, as used along side crotch seams 30 and 32. Notice that midcrotch section 22 is double layered. As shown in FIG. 5, side crotch section 18 is positioned between the two layers of midcrotch section 22. The edges are sewn together, and the two layers of midcrotch section 22 are then folded over to cover the exposed stitching. In this way, none of the stitches creating this seam are allowed to contact the woman's body.

Pantie 10 is made of material which is preferably lightweight and somewhat elastic. The material should also be somewhat resilient to provide support and a proper fit. A preferred material is cotton polyester containing lycra. Single knit or interlock stitching can be used, but interlock stitching is preferred as it provides a more stretchy fabric. It is desirable for the pantie to stretch and expand to accommodate the increasing size of a woman's waist and hip areas during pregnancy.

Over time, and after much usage, the material of pantie 10 will necessarily lose some of its resiliency. Waist edge 36 is therefore provided with elastic waistband 38 to provide added resiliency and support along waist edge 36. Waistband 38 is preferably sewn along the entire waist edge 36. Similarly, leg edges 40 and 42 are provided with elastic strips 44 and 46, respectively.

A pair of mating fasteners 48 and 50, or mating strips, are strategically sewn near the waist edge of rear section 14. Mating strips 48 and 50 are preferably velcro or velcro-mating material. These strips 48 and 50 are strategically located to provide a convenient attachment location for the support panel 60 to be temporarily fastened to the pantie 10, as will be explained in more detail below.

Support panel 60 has a crotch edge 61, two lower side edges 62 and 64, two middle side edges 66 and 68, and two upper side edges 70 and 72, and top edge 73.

Crotch edge 61 and lower side edges 62 and 64 conform to the shape of top front crotch seam 24 and lower front crotch seams 26 and 28. Panel 60 is attached permanently to pantie 10 by sewing crotch edge 61 and lower side edges 62 and 64 into, and along with, crotch seams 24, 26, and 28.

Exposed middle side edges 66 and 68 are stengthened and supported by elastic strips 78 and 80, which are sewn thereon.

Fasteners 74 and 76, which are preferably velcro strips adapted to mate with the velcro material of strips 48 and 50, are fixed to the support panel 60 near the upper top edges 70 and 72. These velcro strips 74 and 76 are adapted to temporarily mate with strips 48 and 50. The location of these fasteners 78 and 80, together with the location of the velcro strips 48 and 50, provide the pregnant woman with a means to adjust the support provided by the fastened support panel 60.

Support panel 60 is shaped to contain and support any expansion of the woman's abdominal area. Panel 60 is preferably made of a similar material as the pantie 10. The material used for support panel 60 should be bi-axially stretchable, but with preferably more vertical stretch than horizontal stretch. This has been shown to offer the greatest support and relief from muscle strain.

When pantie 10 is first put on in its normal position, panel 60 is adjusted to comfortably conform to, and provide lift and support to, the abdominal area of the woman wearing the pantie 10. When the desired lift and support is achieved, the position of the panel 60 is maintained by fastening each of the fasteners 78 and 80 to a respective portion of mating strips 48 and 50. The size, length, and location of fastening strips 48 and 50 are purposely designed, together with the location of the fasteners 74 and 76, to allow the support panel 60 to be positioned in any of a plurality of settings to conform to and provide appropriate lift and support to any of the plurality of the sizes and shapes which might occur during the entire duration of her pregnancy. As the pregnancy proceeds, and the abdominal area grows in size and shape, the support panel can be readjusted to the appropriate position.

An alternative preferred embodiment of this invention is shown if FIGS. 6 through 9. This embodiment provides a brief-style pantie 90 with a slightly different design. Pantie 90 is constructed of only three sections, including a front section 92, a rear section 94, and a crotch section 96. When these three sections are sewn together, they define front crotch seam 98 and rear crotch seam 100.

Pantie 90 is provided with a waistband 104 along waist edge 102 as in the previous embodiment. Similarly, leg edges 106 and 108 are provided with elastic leg bands 110 and 112.

In lieu of the two fastener strips provided on pantie 10 of the first embodiment, the brief style pantie 90 of this embodiment is provided with a single fastener strip 114 along the entire waist edge 102 of rear section 94.

Support panel 120 includes crotch edge 121, lower side edges 122 and 124, upper side edges 126 and 128, and top edge 129.

Crotch edge 122 conforms to, and is sewn into, front crotch seam 98. A lower portion of lower side edges 122 and 124, conforms to and is sewn together with a respective portion of leg edges 106 and 108.

Crotch edge 121 is sewn with front crotch seam 98 preferably using the same foldover stitch 34 shown in FIG. 5, to provide a comfortable seam for the woman wearing the pantie.

The leg bands 110 and 112 which are sewn along leg edges 106 and 108 conveniently provide further support and coverage of the lower side edge portions of the support panel 120 which is sewn together with leg edges 106 and 108. The integral attachment of the lower side edges 122 and 124 to the leg edges 106 and 108 provide a secure and comfortable attachment which assists in providing the proper abdominal support.

The exposed edges of support panel 120, including the upper portion of lower side edges 122 and 124, and top edge 129, are provided with elastic strips 134, 136 and 138, respectively.

Fasteners 130 and 132 are sewn into the panel 120 near the top edge of upper side edges 126 and 128, as in the previous embodiment.

Although the design of this brief style pantie 90 is very different from the pantie 10 of the previous embodiment, the woman wearing this pantie 90 is provided with similar abdominal support which can be adjusted to an even greater extent with this design. The greater adjustment is provided by the additional area on the rear section 94 which is covered with the preferably velcro fastening strip 114.

The invention is not limited to the embodiments described above, but all changes and modifications thereof not constituting departures from the spirit and scope of the invention are intended to be included.

I claim:

1. A maternity support undergarment comprising:

a pantie having a rear waist area, leg edges and a crotch portion;

a plurality of first fasteners fixed to said rear waist area;

an adjustable support panel having a crotch edge, side portions lower side edges extending from opposite sides of said crotch edge, middle side edges extending from said lower side edges, and a top edge area opposite said crotch edge;

said crotch edge being integrally formed with said crotch said lower side edges are secured to said panty portion;

at least one of a second set of fasteners fixed to each of said side portions, each of said second fasteners adapted to temporarily mate with any one of said first fasteners;

selective mating of said fasteners adapted to allow said panel to be adjusted whereby said top edge area provides lift and support to the plurality of sizes and shapes of a woman's abdominal area throughout her pregnancy.

2. The maternity support undergarment as set forth in claim 1 wherein said support panel is made of material which is biaxially stretchable; said biaxially stretchable material having greater relative elasticity in a first axial direction from said crotch edge to said top edge area than in a second axial direction along said top edge area.

3. The maternity support undergarment as set forth in claim 1 further comprising:

at least one seam sewn in said crotch portion; and said crotch edge sewn together with said at least one seam.

4. The maternity support undergarment as set forth in claim 1 further comprising at least a portion of each of two lower side edges of said support panel being sewn together with a portion of a respective one of said two leg edges whereby additional strength is provided to said lift and support of the women's abdominal area.

5. A maternity support undergarment comprising:

a pantie having a waist edge defined by the edge of the pantie which normally surrounds a women's waist when said pantie is worn by the woman; said pantie further having two leg edges defined by the edges of the pantie which normally surrounds a women's thighs when said pantie is worn by the woman; said pantie further having at least one seam in a crotch portion; said crotch portion defined by the portion of the pantie which normally covers a women's crotch when said pantie is worn by the woman;

a support panel having a front side and a back side; said support panel further having a crotch edge sewn together with the seam in said crotch portion of said pantie; said support panel further having a top edge opposite said crotch edge, said top edge being relatively longer than said crotch edge; said support panel further having two upper side edges each adjacent a respective end of said top edge, and said support panel further having two lower side edges each extending from a respective one of said upper side edges to a respective end of said crotch edge; said support panel further having a first axial direction parallel to said top edge and a second axial direction perpendicular to said top edge;

a first set of fasteners fixed to a plurality of locations on the rear area of said pantie near said waist edge;

a second set of at least two fasteners each fixed to a respective one of said two upper side edges of said support panel; said second set of fasteners each adapted to temporarily mate with at least a portion of said first set of fasteners, whereby said two upper side edges of said support panel are each temporarily fastened to said pantie at one of said plurality of locations which allows the support panel to provide lift and support to any one of a plurality of sizes and shapes of the women's abdominal area when said pantie is worn by the woman.

* * * * *